US005716767A

United States Patent [19]

Wernicke et al.

[11] Patent Number: 5,716,767

[45] Date of Patent: Feb. 10, 1998

[54] BLEACHING BATH FOR PHOTOGRAPHIC BLACK-&-WHITE MATERIAL

[75] Inventors: Ubbo Wernicke, Rösrath; Ralf Wichmann, Bergisch Gladbach, both of Germany

[73] Assignee: Agfa-Gevaert AG, Germany

[21] Appl. No.: 768,142

[22] Filed: Dec. 17, 1996

[30] Foreign Application Priority Data

Dec. 29, 1995 [DE] Germany ..... 195 49 103.3

[51] Int. Cl.[6] ..... G03C 5/44

[52] U.S. Cl. ..... 430/461; 430/430

[58] Field of Search ..... 430/461; 134/2, 134/3; 510/191, 195, 199, 219, 238, 240, 363, 367, 372, 375

[56] References Cited

U.S. PATENT DOCUMENTS

| | | | |
|---|---|---|---|
| 1,389,742 | 9/1921 | Crabtree | 430/370 |
| 1,600,797 | 9/1926 | Capstaff | 430/461 |
| 1,688,540 | 10/1928 | Franko | 510/372 |
| 2,494,068 | 1/1950 | Speck | 430/326 |
| 2,843,482 | 7/1958 | Kride | 430/461 |
| 2,871,110 | 1/1959 | Stead | 134/3 |
| 2,904,414 | 9/1959 | Ostrander | 134/3 |
| 3,042,520 | 7/1962 | Johnson | 430/461 |
| 3,061,433 | 10/1962 | Smith et al. | 430/461 |
| 3,256,092 | 6/1966 | Means et al. | 430/461 |
| 3,264,107 | 8/1966 | Wartburg | 430/461 |
| 3,342,598 | 9/1967 | Bard | 430/461 |
| 3,600,166 | 8/1971 | Sieg et al. | 430/461 |
| 3,676,219 | 7/1972 | Schroeder et al. | 134/3 |
| 3,707,374 | 12/1972 | Voorn et al. | 430/461 |
| 3,785,866 | 1/1974 | Frey | 134/3 |
| 3,960,565 | 6/1976 | Fisch et al. | 430/393 |
| 3,962,108 | 6/1976 | Perruccio | 134/3 |
| 4,032,359 | 6/1977 | Fisher et al. | 134/3 |
| 4,045,222 | 8/1977 | Shinozaki et al. | 430/302 |
| 4,328,306 | 5/1982 | Idota et al. | 430/461 |
| 4,339,282 | 7/1982 | Lada et al. | 134/3 |
| 4,608,091 | 8/1986 | Sullivan et al. | 510/372 |
| 4,828,743 | 5/1989 | Rahfields et al. | 510/191 |
| 5,354,383 | 10/1994 | Bianchi | 134/3 |
| 5,393,447 | 2/1995 | Carlson et al. | 510/372 |
| 5,441,665 | 8/1995 | Massaioli | 510/372 |
| 5,451,491 | 9/1995 | Szajewski et al. | 430/461 |

FOREIGN PATENT DOCUMENTS

| | | |
|---|---|---|
| 518662 | 3/1940 | United Kingdom . |
| 1 092 258 | 12/1964 | United Kingdom . |
| 1 376 519 | 12/1974 | United Kingdom . |
| 1 425 361 | 2/1976 | United Kingdom . |
| 1 546 907 | 5/1979 | United Kingdom . |

OTHER PUBLICATIONS

H.J. Price et al., Research Disclosure, vol. 157, "Use of persulfate bleaching agents in photographic processing", (May 1977).

*Primary Examiner*—Hoa Van Le

*Attorney, Agent, or Firm*—Connolly & Hutz

[57] ABSTRACT

A bleaching bath for photographic black-&-white silver halide materials characterised by the combination of at least 2 oxidising agents having an oxidising potential of ≧500 mV, optionally together with a metal salt having a stabilising action of a metal of subgroups 1 or 2 of the periodic system of elements, wherein, in the event that dichromate is used as one of the oxidising agents, it is used in a quantity of at most 3.4 mmol/l.

11 Claims, No Drawings

BLEACHING BATH FOR PHOTOGRAPHIC BLACK-&-WHITE MATERIAL

This invention relates to a bleaching bath for black-&-white photographic material.

When processing black-&-white reversal films and in micrographics and the graphics sector, the developed silver is bleached with bleaching baths which contain a strongly acidic potassium dichromate solution containing approximately 7.5 g of $K_2Cr_2O_7$/l as the oxidising agent. A soluble silver salt, for example silver sulphate ($Ag_2SO_4$), is formed during the bleaching operation, and is rapidly washed out of the photographic layer.

It has become important on environmental grounds to reduce the quantity of dichromate or, preferably, entirely to avoid bleaching baths containing dichromate.

Substances having a similarly high electrochemical oxidation potential as dichromate, such as for example salts of tetravalent cerium, heptavalent manganese, trivalent iron and persulphate solutions are not suitable because, even at elevated concentration, they oxidise metallic silver only slowly (bleaching times of more than 10 minutes) or because, as in the case of heptavalent manganese, while they are indeed sufficiently active, they are so unstable in solution that they decompose after a short time and deposit manganese dioxide on the tank walls, in the hoses, on all equipment components and on the belts.

Combining the stated oxidising agents with known bleaching accelerators, for example thioglycerol, is also unsuccessful because bleaching times still remain above 10 minutes. Moreover, this method requires an additional bath (prebath) because sulphur compounds such as thioglycerol are immediately oxidised by the oxidising agent in a combined bath and thus rendered ineffective.

The object of the invention was accordingly to provide a bleaching bath for black-&-white silver halide materials which allows bleaching in a reasonable time (<10 minutes), is stable, may be used in continuous regeneration operation and contains at most 3.4 mmol of dichromate/l. The bleaching bath should preferably contain no dichromate.

This object is surprisingly achieved by the combination of at least 2 oxidising agents having an oxidising potential of ≧500 mV, optionally together with a metal salt having a stabilising action of a metal of subgroups 1 or 2 of the periodic system of elements, wherein, in the event that dichromate is used as one of the oxidising agents, it is used in a quantity of at most 3.4 mmol/l.

Suitable oxidising agents are, for example, persulphates and metal salts in elevated valence states.

Suitable persulphates are, for example $Na_2S_2O_8$, $K_2S_2O_8$ and $(NH_4)_2S_2O_8$.

Metal salts having an elevated valence state are, for example, salts of tetravalent cerium, heptavalent manganese and trivalent iron.

Metal salts of subgroups 1 and 2 are, for example, $AgNO_3$, $CuSO_4$, $ZnSO_4$ and $CdSO_4$. Surprisingly, these metal salts stabilise permanganate solutions, for example, so suppressing the formation of manganese dioxide.

The persulphates are in particular used in a quantity of 0.001 to 0.5 mol/l, preferably of 0.01 to 0.1 mol/l.

The metal salts having an elevated valence state are in particular used in a quantity of 0.001 to 0.2 mol/l, preferably of 0.01 to 0.1 mol/l, wherein, as stated, the quantity of dichromate does not exceed 3.4 mmol/l.

The metal salts of subgroups 1 and 2 are in particular used in a quantity of $10^{-1}$ to $10^{-4}$ mol/l, preferably of $5\cdot10^{-2}$ to $5\cdot10^{-4}$ mol/l.

The bleaching bath according to the invention in particular has a pH value of 0 to 2, preferably of 0.1 to 1.5.

In order to shorten the bleaching time, an upstream bath with a bleaching accelerator, for example thioglycerol or 3-mercapto-1,2,4-triazole, may be used. This bath preferably contains the compound containing sulphur in a quantity of $10^{-4}$ to $10^{-1}$ mol/l.

Bleaching baths according to the invention, which contain a persulphate and a metal salt having an oxidation potential of ≧500 mV, may decompose on extended storage. It is thus convenient to store the components separately, to mix them only shortly before use and to adjust them to the desired pH value with acid.

The bleaching bath components may be stored separately both as solids and as aqueous concentrates.

EXAMPLES

A conventional commercial black-&-white film, for example Agfapan APX-100, was exposed with a grey step wedge, developed for 8 minutes at 20° C. in a conventional commercial black-&-white developer (for example Refinal), fixed, rinsed and dried.

The resultant grey step wedges were then treated with bleaching baths of different compositions and the time required in order completely to bleach the metallic silver of the grey step wedge, i.e. until only the clear film base was visible, was determined.

Parameters such as temperature and stirring were kept constant in the bleaching process. The pH value was adjusted in each case.

In the case of long bleaching times of >5 minutes, a fixed bleaching time was selected and residual density measured. Bleaching times in excess of 10 minutes were no further assessed.

Residual density is defined as the densitometrically measured density of the silver image minus the density of the film base.

Since initial density is 2.4 for all the tests, the result of subtracting residual density from initial density is a measure of the effectiveness of the bleaching bath.

The results are shown in the following table. Quantities relate in each case to 1 liter.

| Examples | Prebath | Bleaching bath | | Time | Residual density |
|---|---|---|---|---|---|
| 1 | no | 7.5 g $K_2Cr_2O_7$ | pH 1.0 | 2 min | 0.07 |
| 2 | no | 4 g $K_2Cr_2O_7$ | pH 0.1 | 7 min | 0.09 |
| 3 | no | 6 g $Ce(SO_4)_2$ | pH 1.0 | >15 min | — |
| 4 | no | 6 g $Ce(SO_4)_2$ | pH 0.1 | >15 min | — |
| 5 | no | 18 g $Fe(NO_3)_3$ | pH 1.0 | >15 min | — |
| 6 | no | 18 g $Fe(NO_3)_3$ | pH 0.1 | >15 min | — |

-continued

| Examples | Prebath | Bleaching bath | | Time | Residual density |
|---|---|---|---|---|---|
| 7 | no | 54 g $K_2S_2O_8$ | pH 0.1 | >15 min | — |
| 8 | no | 54 g $(NH_4)_2S_2O_8$ | pH 0.1 | >15 min | — |
| 9 | no | 4 g $KMnO_4$ | pH 1.0 | 4 min* | — |
| 10 | yes | 6 g $Ce(SO_4)_2$ | pH 1.0 | >10 min | — |
| 11 | yes | 6 g $Ce(SO_4)_2$ | pH 0.1 | 10 min | — |
| 12 | yes | 18 g $Fe(NO_3)_3$ | pH 1.0 | >10 min | — |
| 13 | yes | 18 g $Fe(NO_3)_3$ | pH 0.1 | >10 min | — |
| 14 | yes | 54 g $K_2S_2O_8$ | pH 0.1 | >10 min | — |
| 15 | yes | 54 g $(NH_4)_2S_2O_8$ | pH 0.1 | >10 min | — |
| 16 | yes | 4 g $KMnO_4$ | pH 1.0 | 4 min* | — |
| 17 | no | 50 g $K_2S_2O_8$ + 6 g $Ce(SO_4)_2$ | pH 0.1 | 2 min | 2.02 |
| 18 | no | 50 g $K_2S_2O_8$ + 18 g $Fe(NO_3)_3$ | pH 0.1 | 2 min* | 2.16 |
| 19 | no | 50 g $K_2S_2O_8$ + 2 g $KMnO_4$ | pH 0.1 | 2 min | 0.12 |
| 20 | no | 50 g $(NH_4)_2S_2O_8$ + 6 g $Ce(SO_4)_2$ | pH 0.1 | 2 min | 1.81 |
| 21 | no | 50 g $(NH_4)_2S_2O_8$ + 18 g $Fe(NO_3)_3$ | pH 0.1 | 2 min* | 2.08 |
| 22 | no | 50 g $(NH_4)_2S_2O_8$ + 2 g $KMnO_4$ | pH 0.1 | 2 min | 0.09 |
| 23 | yes | 50 g $(NH_4)_2S_2O_8$ + 6 g $Ce(SO_4)_2$ | pH 0.1 | 2 min | 0.67 |
| 24 | yes | 50 g $(NH_4)_2S_2O_8$ + 18 g $Fe(NO_3)_3$ | pH 0.1 | 2 min | 0.60 |
| 25 | no | 50 g $(NH_4)_2S_2O_8$ + 1 g $KMnO_4$ | pH 0.1 | 2 min* | 0.15 |
| 26 | no | 50 g $(NH_4)_2S_2O_8$ + 1 g $KMnO_4$ + 100 mg $AgNO_3$ | pH 0.1 | 2 min | 0.15 |
| 27 | no | 50 g $(NH_4)_2S_2O_8$ + 5 g $KMnO_4$ | pH 0.1 | 2 min* | 0.08 |
| 28 | no | 50 g $(NH_4)_2S_2O_8$ + 5 g $KMnO_4$ + 100 mg $AgNO_3$ | pH 0.1 | 2 min | 0.08 |
| 29 | no | 50 g $(NH_4)_2S_2O_8$ + 1 g $KMnO_4$ + 1 g $K_2Cr_2O_7$ | pH 0.1 | 2 min* | 0.10 |
| 30 | no | 50 g $(NH_4)_2S_2O_8$ + 1 g $KMnO_4$ + 1 g $K_2Cr_2O_7$ + 100 mg $AgNO_3$ | pH 0.1 | 2 min | 0.09 |
| 31 | no | 50 g $(NH_4)_2S_2O_8$ + 1 g $KMnO_4$ + 1 g $K_2Cr_2O_7$ + 500 mg $AgNO_3$ | pH 0.1 | 2 min | 0.09 |
| 32 | no | 50 g $(NH_4)_2S_2O_8$ + 1 g $K_2Cr_2O_7$ | pH 0.1 | 2 min | 0.14 |
| 33 | no | 50 g $K_2S_2O_8$ + 1 g $K_2Cr_2O_7$ | pH 0.1 | 2 min | 0.17 |

*means formation of manganese dioxide.

"Prebath, yes" means that, before the bleaching bath, the material was treated for 2 minutes with a solution of 5 g of thioglycerol/l.

Examples 1 and 2 are reference examples describing current practice.

Examples 3 to 16 are comparative examples which demonstrate that oxidising agents having an oxidising potential comparable with that of dichromate alone give inadequate bleaching results. While $KMnO_4$ (in Examples 9 and 16) does indeed exhibit adequate bleaching action, these Examples are not usable due to the formation of manganese dioxide deposits.

It is only once 2 oxidising agents having an oxidising potential of ≧500 mV are combined that the surprising success is achieved (Examples 17 to 33), wherein addition of salts of subgroups 1 or 2 of the periodic system of elements makes even $KMnO_4$ usable, as the bleaching baths of Examples 25 to 28 achieve the following result after 48 hours:

Examples 26 and 28: appearance unchanged, bleaching action fully retained;

Examples 25 and 27: formation of manganese dioxide deposits, bleaching action greatly reduced.

Examples 29 to 33 show that, in combination with other oxidising agents, smaller quantities of dichromate than those hitherto conventional also give the desired success.

We claim:

1. A bleaching bath for photographic black-&-white silver halide materials which comprises the combination of (a) a persulphate and (b) $KMnO_4$ together with $AgNO_3$, wherein In the event that the bleaching bath contains dichromate, dichromate is used in a quantity of at most 3.4 mol/l.

2. The bleaching bath according to claim 1, wherein (a) is used in a quantity of 0.001 to 0.5 mol/l, (b) in a quantity of 0.001 to 0.2 mol/l and $AgNO_3$ in a quantity of $10^{-1}$ to $10^{-4}$ mol/l.

3. The bleaching bath according to claim 1, wherein said bath contains no dichromate.

4. The bleaching bath according to claim 1, wherein said persulphates are $Na_2S_2O_8$, $K_2S_2O_8$ or $(NH_4)_2S_2O_8$.

5. The breaching bath according to claim 1, wherein (a) is used in an amount from 0.01 to 0.1 mol/l and the $AgNO_3$ is used in an amount of from 0.01 to 0.1 mol/l.

6. The breaching bath according to claim 1, wherein the pH value is from 0 to 2.

7. The bleaching bath according to claim 1, wherein said persulphates are $Na_2S_2O_8$, $K_2S_2O_8$ or $(NH_4)_2S_2O_8$ and the metal salt of a metal in the elevated valence state is tetravalent cerium, heptavelent manganese or trivalent iron.

8. The bleaching bath according to claim 1, wherein the metal salt of a metal of subgroup 1 or subgroup 2 is $AgNO_3$, $CuSO_4$, $ZnSO_4$ or $CdSO_4$.

9. The bleaching bath according to claim 8, wherein the persulphates are used in an amount from 0.01 to 0.1 mol/l and the metal salts is used in an amount from 0.01 to 0.1 mol/l.

10. The bleching bath as claimed in claim 9, wherein said bath has a pH value of 0 to 2.

11. The bleaching bath as claimed in claim 10, wherein the pH value is from 0.1 to 1.5.

* * * * *